United States Patent [19]

Meijer

[11] Patent Number: 4,889,181

[45] Date of Patent: Dec. 26, 1989

[54] HEAT EXCHANGER AND SHEET MATERIAL THEREFOR

[76] Inventor: Sjoerd Meijer, No. 894, Oude Bildtdijk, NL 9097 NG St. Jacobiparochie, Netherlands

[21] Appl. No.: 263,879

[22] Filed: Oct. 28, 1988

[30] Foreign Application Priority Data

Oct. 30, 1987 [NL] Netherlands ..... 8702600

[51] Int. Cl.[4] ..... F28F 13/14; F28F 1/08; F28F 1/20

[52] U.S. Cl. ..... 165/78; 165/164; 165/154; 165/131; 165/183; 126/108; 126/119

[58] Field of Search ..... 165/164, 183, 78, 131, 165/154; 126/108, 119

[56] References Cited

U.S. PATENT DOCUMENTS 755,399 3/1904 Shambaugh ..... 165/183
851,978 4/1907 Bigsby et al. ..... 165/183
1,613,253 1/1927 Stolp .
1,775,173 9/1930 Phelps et al. ..... 165/131
1,890,625 12/1932 Shaw ..... 165/131

FOREIGN PATENT DOCUMENTS 2749397 5/1979 Fed. Rep. of Germany .

*Primary Examiner*—Albert W. Davis, Jr.
*Attorney, Agent, or Firm*—John P. Snyder

[57] ABSTRACT

A bulkhead is formed of a sheet of material which is preformed so as to have alternatingly opposed S-shaped creases at spaced intervals which define pairs of mutually facing recessed grooves between adjacent creases. Resilient surface area enlarging members are each provided with a pair of lips formed on the opposite edges thereof. Each pair of lips are received within a pair of mutually facing recessed grooves of the bulkhead. The surface area enlarging members can be snapped into or out of operative position with respect to the bulkhead to adjust the surface area of the device.

16 Claims, 4 Drawing Sheets

HEAT EXCHANGER AND SHEET MATERIAL THEREFOR

The invention relates to a heat exchanger as described in the heading of claim 1. The surface-area increasing members are fitted in accordance with the intended capacity per unit surface area of the heat exchanger. For a specific application, the total effective surface area needed in order to achieve a desired heat transmission can be determined in advance. This kind of accurate advance determination may be laborious or unfeasible, for example in the case of small production quantities or in the case of certain applications.

For example, in the case of a heat exchanger for a gas heater, it is not really possible to calculate the total surface area required for an optimal output. The performance of a gas heater is namely influenced by the circumstances under which it operates, in particular by the chimney draught. In the case of a poorly-functioning chimney the heat exchanger requires a smaller heat-exchanging surface, so that the combustion gas to be discharged will still have a sufficiently high temperature to be effectively extracted through the chimney. A manufacturer of such a gas heater will generally determine the dimensions of the heat exchanger on the basis of these relatively unfavourable circumstances. This means that in other cases, where a good chimney draught is in fact available, the heater delivers a less than optimal output. For an optimal performance it is thus desirable that the heat exchanging surface can be adapted to the circumstances.

The invention has for its object to provide a heat exchanger of the kind described in the preamble which can also be fabricated efficiently in small production quantities and which is in principle suitable for a simple adjustment of its total heat exchanging surface area.

According to the invention this is achieved through the measures claimed in the characteristic of claim 1. Through these measures a specific quantity of profile members of a desired form can be mounted, according to the desired total heat exchange-surface area.

In the cited example of a heat exchanger for a gas heater, the manufacturer can design and make the heat exchanger for application with an effective chimney. When it becomes apparent during use that the combustion gas is not being extracted satisfactorily—something which can easily be detected, for example through condensation on external windows-one or more profile members can be removed by the user, so that the combustion gas leaves the heat exchanger with a higher temperature and can thus be better extracted by a non-optimally functioning chimney.

The fabrication of the heat exchanger according to the invention is simple. The bulkhead can be formed as sheet material into the desired shape, whereafter the required number of profile members with a suitable length can be arranged in the grooves.

Through the alternatingly opposed S-shaped creases, sideways-recessed grooves which face towards each other are formed on both sides of the bulkhead. Profile members can therefore be accommodated on both sides of the bulkhead.

When adjustability of the total heat exchanging surface area is not necessary or not desired, the embodiment according to claim 5 can be used with advantage. In this manner the bulkhead and profile members are joined together as an entity, with the concomitant advantage of an improved heat transfer at the point of the contact surfaces of the profile members in the grooves.

A further development of the invention is characterized in claim 6. Through this, the material can be pressed flat to a uniform thickness and known sheet-material working methods such as seam folding can be used. The bulkhead of a heat exchanger can thereby be completed fully sealed by a folding operation on an end edge transverse to the longitudinal direction of the S-creases.

The invention also relates to and provides a sheet material that is intended for the fabrication of a heat exchanger according to the invention. This sheet material is characterized in that in cross section it displays a profile with alternatingly opposed S-shaped creases spaced at intervals. This sheet material can be formed into a required shape using normal sheet-material working techniques, whereafter an arbitrary heat exchanger can be obtained in a simple way by the addition of profile members.

The invention will hereinafter be further elucidated by reference to the embodiments shown in the figures.

Figure 1:
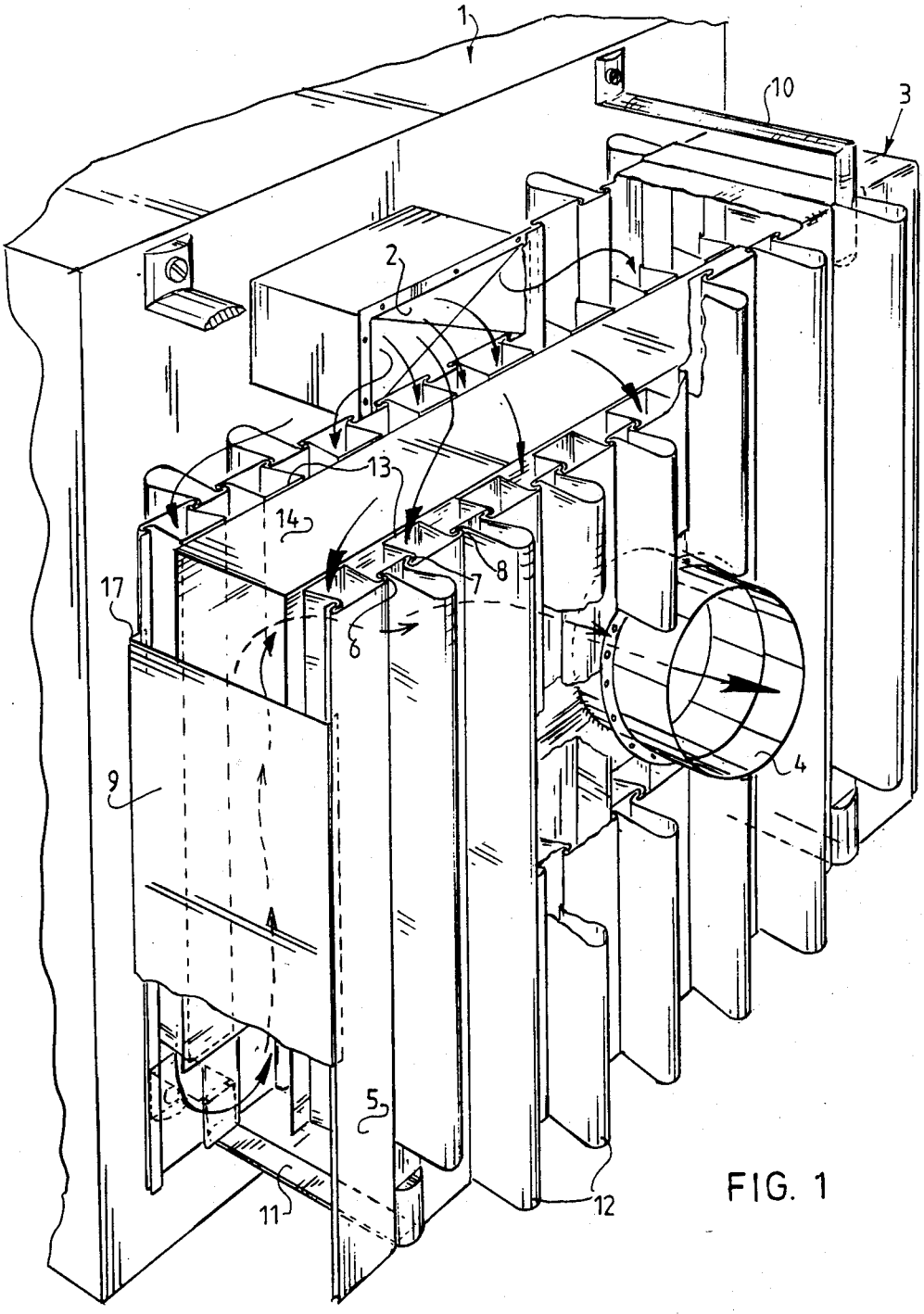
FIG. 1 shows a partly broken away perspective view of a heat exchanger according to the invention, for a gas heater.
Figure 2:
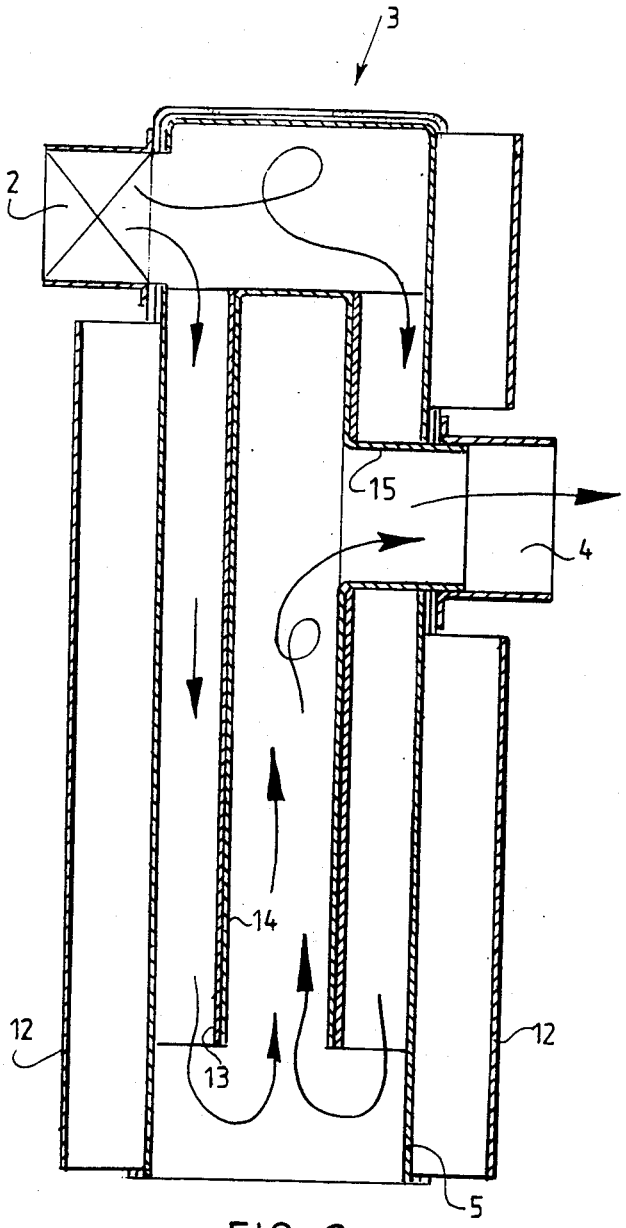
FIG. 2 shows a vertical section of the heat exchanger of FIG. 1.

As FIG. 1 shows, a heat exchanger 3 according to the invention is mounted on the rear side of a gas heater 1. The combustion gas enters the heat exchanger 3 via the inlet 2. In the heat exchanger 3, the hot combustion gas imparts a portion of its heat to the surrounding air. The heat exchanger 3 comprises a bulkhead 5 bent over into a box form, which mutually separates the circulation space for the combustion gas inside the heat exchanger 3 on the one hand from the circulation space for the air to be heated outside the heat exchanger on the other. As FIGS. 1 and 2 show, an inverted U-shaped guide 14 is mounted in the heat exchanger 3. This guide ensures that combustion gas entering via the inlet 2 moves downwards along the bulkhead to the bottom of the heat exchanger, and then flows upwards inside the guide and exits the heat exchanger via an integral spout 15 and via the outlet 4 connected to the chimney. The heat exchanger is open at the bottom, so that any back pressure resulting for instance from a fall wind cannot travel into the heater as far as the burner. The construction of the heat exchanger with integral fall wind deflector is known per se.

In accordance with the invention, the bulkhead 5 of the heat exchanger according to the invention has a profile with alternatingly opposed S-shaped creases spaced at intervals. Three of these creases are identified by reference numbers 6, 7 and 8. As can be seen, the S-shaped crease 7 is opposite to S-shaped crease 6, and similarly the S-shaped crease 8 is opposite to the adjacent S-shaped crease 7. Two opposed S-shaped creases, for instance 6 and 7, define sideways-recessed grooves which face towards each other. The creases 6 and 7 form such grooves on the outside and the creases 7 and 8 form such grooves on the inside of the heat exchanger 3. The curved profile members 12 and 13 respectively are held in these pairs of grooves. These members are bent from sheet material and are provided at their lower ends with projecting lips, which grip in opposite grooves. The profiled members 12 and 13 clamp firmly in the grooves through their own resilience. The contact pressure caused by the spring force affords a good heat-conducting junction between the bulkhead and the profile members. It will be apparent that when it is desired to reduce the capacity of the heat exchanger, one or more of the profile members 12 or possibly 13 may be removed.

As observed earlier, the heat exchanger according to the invention can be simple to manufacture. The bulkhead 5 is folded by use of the normal sheet material working techniques into the U-shaped shown. Mounted at the ends are the closing side caps 9, which are held by a flange 17 at sides and top in the S-crease at the end of the bulkhead 5. The caps 9, and similarly the profile members 12 and 13, can optionally be fastened by spot welding.

Figure 3:
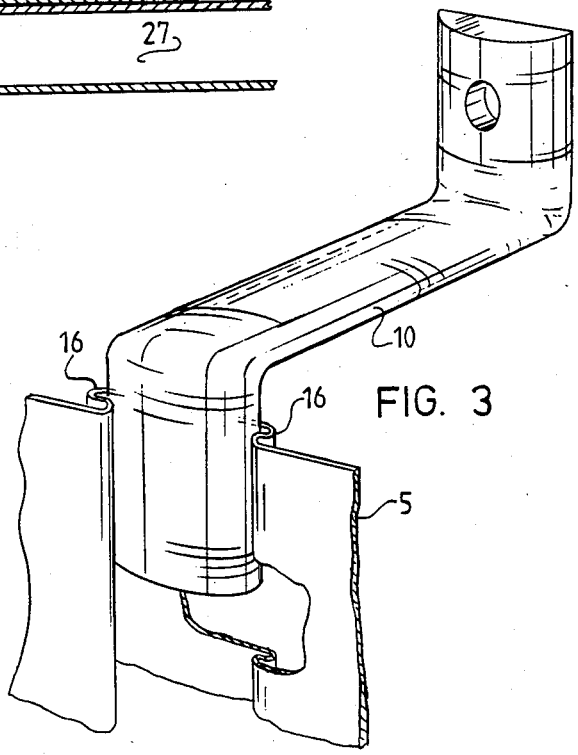
FIG. 3 shows a detail of the mounting bracket of the heat exchanger according to FIG. 1.

As shown in FIGS. 1 and 3, the bulkhead made with S-creases according to the invention has the further advantage that the mounting brackets 10, 11 can simply grip therein. A mounting bracket 10 is shown in more detail in FIG. 3. This bracket 10 is fabricated from a piece of commercially-available half-round section, one end of which is thrust between the two S-creases 16. At the other end, the bracket 10 is fastened to the carcass of the heater 1.

The bracket 11 fastens the heat exchanger at the bottom to the heater 1 in a similar way, and at the same time fixes the two opposite wall parts of the bulkhead 5 at the desired distance from each other.

Figure 4:
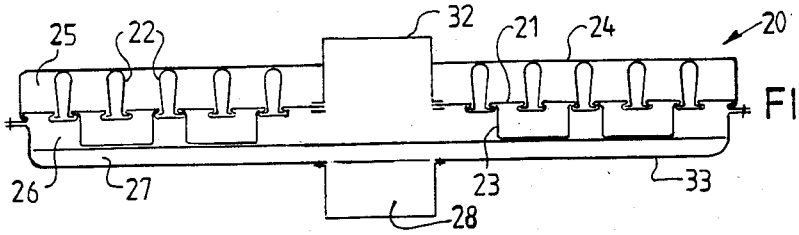
FIG. 4 shows a horizontal section of an alternative embodiment of a heat exchanger.
Figure 5:
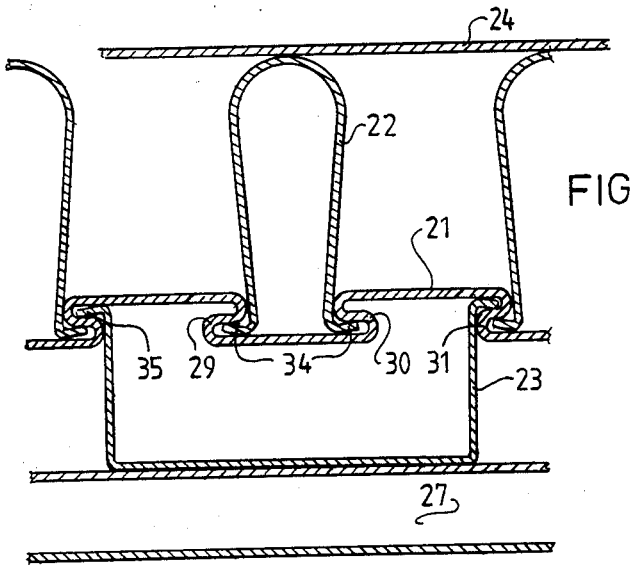
FIG. 5 shows an enlarged detail view of FIG. 4.

The heat exchanger shown in FIGS. 4 and 5 is similarly intended for a heater. The heat exchanger 20 comprises a bulkhead 21 which again is provided with alternatingly opposed S-shaped creases 29, 30, 31 spaced at intervals. A cap 33 is connected to the side and upper edges of the bulkhead 21, which cap forms together with the bulkhead 21 a circulation space for the combustion gases. On the other side bulkhead 21 is connected, along its side edges only, to a cap 24 which together with the bulkhead 21 defines a circulation space 25 for the air to be heated. The combustion gases are supplied via the intake 32 and are discharged via the chimney connection 28. Between the intake and the outlet an extra guide plate is also mounted, which partitions a circulation space 27. The combustion gases can flow downwards into the space 26 and arrive in the space 27 at the bottom of the heat exchanger, where the gas flows upwards to the outlet 28.

In the circulation channel 25, profile members 22 are held repeatedly by two adjacent S-shaped grooves. Accommodated in circulation space 26 are profile members 23 which grip in mutually facing grooves of S-creases which are separated from each other by a distance of three S-creases. As is particularly shown in FIG. 5, the lip edges 34 of the profile members 22 and the lip edges 35 of the profile members 23 are bent back to some extent, such that a good clamping contact is achieved in the respective grooves of the bulkhead 21. Hence a good heat transmission is assured.

In general, various measures can be adopted for ensuring good heat transmission between the profile members and the bulkhead concerned. In many cases the gripping sliding joints shown will be sufficient. In special cases a heat-conducting paste can be applied in the grooves. Another possibility is that after the mounting of the profile members the entire heat exchanger is dipped in a bath of molten metal such as tin or zinc. After cooling, this metal bonds the profile members firmly to the bulkhead. In that case a perfect sealing is also ensured for any surface joint edge transversely of the longitudinal direction of the S-creases. For example, in the heat exchanger of FIG. 4 the cap 33 will be surface joined along the top edge to the bulkhead 21. A good seal can be obtained through use of a seam folded joint of an edge of the cap 33 with the bulkhead 21, possibly with the interposition of a gasket material. Instead of the use of gasket material, a complete seal can also be ensured in the manner described by dipping in a bath of molten metal.

Figure 6:
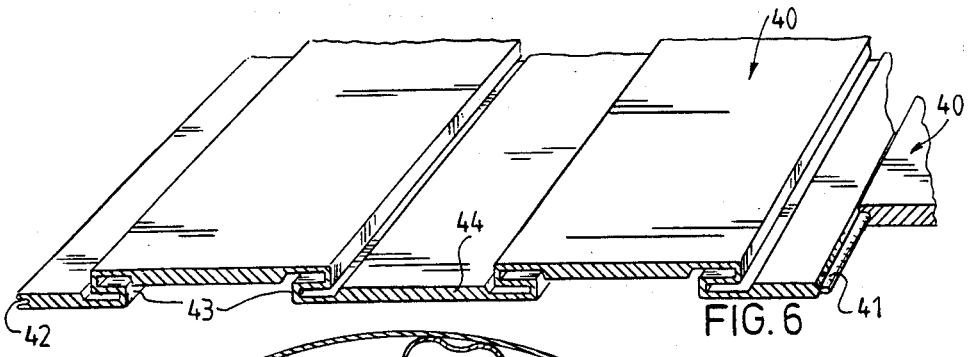
FIG. 6 shows a variant embodiment of sheet material according to the invention intended for a heat exchanger.

FIG. 6 shows another embodiment of sheet material that is intended for a heat exchanger according to the invention. The sheet material is here an extrusion moulding 40 that comprises four S-creases and which is provided along one longitudinal edge with a groove 42 and on the other edge with a tongue 41 which fits into said groove 42. A random number of extruded mouldings 40 can be assembled into a bulkhead of the desired dimensions by the sliding into each other of tongues and grooves 41, 42 respectively.

At the position of the S-creases 43, the wall thickness of the extruded moulding is approximately one third of that of the intervening parts 44. Thus when the S-creases are pressed flat, the sheet material acquires a smooth surface on both sides. In the flattened state, for example, a completely sealed seam folded joint can be formed with an adjoining piece of sheet material.

Figure 7:
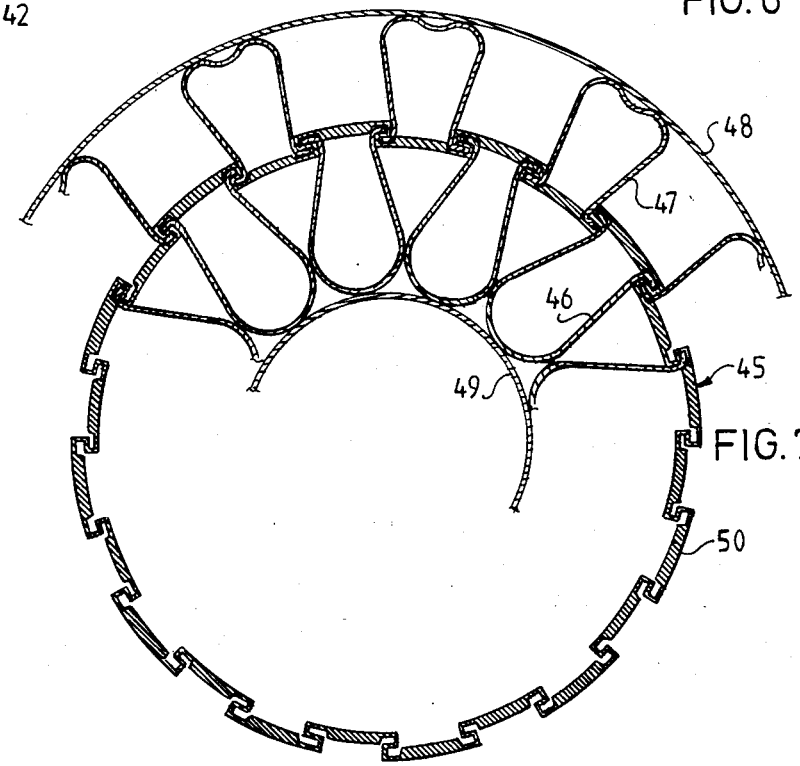
FIG. 7 shows a partial cross section of a tubular heat exchanger according to the invention.

The heat exchanger 45 of FIG. 7 is tube-shaped. The bulkhead 50 itself is tube-shaped and has a profile in cross section which again has alternatingly opposed S-creases spaced at intervals. Profile members 46 are gripped firmly on the inside, and profile members 47 on the outside. Accommodated in the interior amid the profile members 46 is a tube 49, which serves as a flow guide and ensures that the heat exchanging medium remains in good contact with the profile members 46 and the bulkhead 50. The assembly is held in an external tube 48, which ensures in a similar way that the other heat exchanging medium comes into good contact with the profile members 47 and the bulkhead 50.

Figure 8:
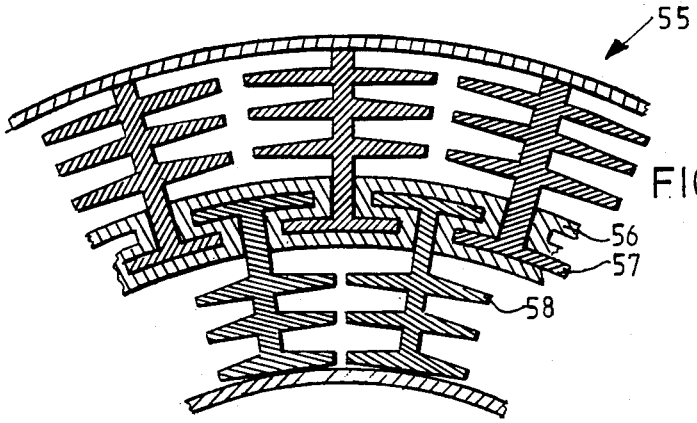
FIG. 8 shows a portion of a variant embodiment of a tubular heat exchanger according to the invention.

The variant shown in FIG. 8 again comprises a bulkhead 56 with alternating S-creases. The profile members 57, 58 are in this example extruded mouldings.

In the above description, a gas-gas heat exchanger has been assumed in all cases. The invention is of course also applicable to liquid-liquid or liquid-gas heat exchangers. In the latter case, for example, profile members will be arranged only on the gas sides of the bulkhead. An example of such an application is a convector of a central heating installation. In that case at least one of the layers of the convector is of sheet material with S-creases according to the invention. For the adjustment of the capacity of the convector, profile members of the desired form can be added or removed in the manner described.

It will be found from the applications described that the sheet material according to the invention, which in cross section has a profile with alternatingly opposed S-creases spaced at intervals, is very generally usable for the fabrication of a heat exchanger.

What is claimed:

1. Heat exchanger comprising at least two circulation spaces for heat-exchanging media, separated from each other by a heat-transmitting bulkhead which supports a plurality of surface-area enlarging members on at least one side, characterized in that said bulkhead has a preformed profile in cross-section with alternatingly opposing S-shaped creases spaced at intervals, and that said surface-area enlarging members are separate profile members each of which is provided with lips at the opposite edges thereof which are received in two mutually facing sideways-recessed grooves which are defined by opposing S-creases.

2. Heat exchanger as claimed in claim 1, characterized in that the bulkhead is manufactured of sheet material.

3. Heat exchanger as claimed in claim 1, characterized in that after the arranging of the profile members this heat exchanger is dipped in a bath of molten metal such as tin or zinc.

4. Heat exchanger comprising at least two circulation spaces for heat-exchanging media, separated from each other by a heat-transmitting bulkhead which supports surface-area enlarging members on at least one side, characterized in that side bulkhead has a profile in cross-section with alternatingly opposing S-shaped creases spaced at intervals, and that said surface-area enlarging members are profile members each received in two mutually facing sideways-recessed grooves which are defined by opposing S-creases, said profile members being held on both sides of the bulkhead.

5. Heat exchanger comprising at least two circulation spaces for heat-exchanging media, separated from each other by a heat-transmitting bulkhead which supports surface-area enlarging members on at least one side, characterized in that said bulkhead has a profile in cross-section with alternatingly opposing S-shaped creases spaced at intervals, and that said surface-area enlarging members are profile members each received in two mutually facing sideways-recessed grooves which are defined by opposing S-creases, said profile members being fabricated from sheet material and grip in the grooves through their own resilience.

6. Heat exchanger comprising at least two circulation spaces for heat-exchanging media, separated from each other by a heat-transmitting bulkhead which supports surface-area enlarging members on at least one side, characterized in that said bulkhead has a profile in cross-section with alternatingly opposing S-shaped creases spaced at intervals, and that said surface-area enlarging members are profile members each received in two mutually facing sideways-recessed grooves which are defined by opposing S-creases, said bulkhead being made of extruded metal, the material thickness at the position of the S-shaped creases amounting to one third of the thickness of the intervening material.

7. Heat exchanger comprising at least two circulation spaces for heat-exchanging media, separated from each other by a heat-transmitting bulkhead which supports surface-area enlarging members on at least one side, characterized in that said bulkhead has a profile in cross-section with alternatingly opposing S-shaped creases spaced at intervals, and that said surface-area enlarging members are profile members each received in two mutually facing sideways-recessed grooves which are defined by opposing S-creases, said bulkhead being folded over transversely of the direction of the creases into a box shape.

8. Heat exchanger as claimed in claim 7, characterized in the faces of the box shape are closed off by covers provided with a bent flange, whereby said flange is received in a groove defined by an S-crease near to the side edge of the bulkhead.

9. A preformed sheet of material intended for a heat exchanger characterized in that it has a profile in cross-section with alternatingly opposed S-shaped creases spaced at intervals defining pairs of mutually facing recessed grooves in adjacent creases for receiving portions of surface-area enlarging members, adjacent pairs of said grooves being disposed on opposite sides of said sheet of material.

10. Sheet material intended for a heat exchanger characterized in that it has a profile in cross-section with alternatingly opposed S-shaped creases spaced at intervals, the wall thickness at the position of the S-shaped creases being one third of the thickness of the intervening material.

11. In a heat exchanger construction, bulkhead means for separating a heating medium space from a heated medium space and through which bulkhead means heat transfer is effected, the bulkhead means comprising a preformed wall construction having a series of channels facing the heated medium side of the bulkhead, each channel having a bottom and an S-shaped configuration at either side of its bottom, said S-shaped configurations defining pairs of opposed grooves adjacent each channel bottom, and a plurality of separate heat transfer-increasing profile means each of which is provided with edge portions received in one of said pair of grooves to be anchored in at least some of the channels in heat-conducting relation to the bulkhead and projecting from a side of the bulkhead into the space on that side of the bulkhead for increasing the heat transfer area on that side of the bulkhead.

12. In a heat exchanger as defined in claim 11 wherein the bulkhead means is formed of sheet metal.

13. In a heat exchanger as defined in claim 11 including heating medium inlet means for discharging heating medium to flow into the heat exchanger and heated medium discharge means for flowing heated medium from the heat exchanger, the profile means channeling either the heating medium or the heated medium.

14. In a heat exchanger construction, bulkhead means for separating a heating medium space from a heated medium space and through which bulkhead means heat transfer is effected, the bulkhead means comprising a wall construction having a series of channels facing the heating medium side of the bulkhead and a series of channels facing the heated medium side of the bulkhead, each channel having a bottom and an S-shaped configuration at either side of its bottom and a plurality of heat transfer-increasing profile means anchored in at least some of the channels in heat-conducting relation to the bulkhead and projecting from a side of the bulkhead into the space on that side of the bulkhead for increasing the heat transfer area on that side of the bulkhead, said bulkhead means being of cylindrical form.

15. In a heat exchanger as defined in claim 14 wherein the bulkhead means comprises a plurality of semi-circular sections each having a tongue alone one edge and a groove along its opposite edge.

16. In a heat exchanger construction, bulkhead means for separating a heating medium space from a heated medium space and through which bulkhead means heat transfer is effected, the bulkhead means comprising a wall construction having a series of channels facing the heating medium side of the bulkhead and a series of channels facing the heated medium side of the bulkhead, each channel having a bottom and an S-shaped configuration at either side of its bottom and a plurality of heat transfer-increasing profile means anchored in at least some of the channels in heat-conducting relation to the bulkhead and projecting from a side of the bulkhead into the space on that side of the bulkhead for increasing the heat transfer area on that side of the bulkhead, and including heating medium inlet means for discharging heating medium to flow into the heat exchanger and heated medium discharge means for flowing heated medium from the heat exchanger, the profile means channeling the heating medium on the heating medium side of the bulkhead and the heated medium on the heated medium side of the bulkhead.

* * * * *